United States Patent [19]

Sato

[11] Patent Number: 4,463,913

[45] Date of Patent: Aug. 7, 1984

[54] SYSTEM AND APPARATUS FOR CONTROLLING THE UNWINDING OF COILED MATERIAL

[75] Inventor: Yoshiaki Sato, Hyogo, Japan

[73] Assignee: Mitsubishi Denki Kabushiki Kaisha, Tokyo, Japan

[21] Appl. No.: 391,454

[22] Filed: Jun. 23, 1982

[30] Foreign Application Priority Data

Jul. 2, 1981 [JP] Japan ..... 56-104929
Jul. 2, 1981 [JP] Japan ..... 56-104931

[51] Int. Cl.[3] ..... B65H 25/00
[52] U.S. Cl. ..... 242/57; 33/132 A
[58] Field of Search ..... 242/57, 75.51; 33/132 A, 132 R, 133, 129, 136; 360/73, 74.2

[56] References Cited

U.S. PATENT DOCUMENTS 3,161,365 12/1964 Johnson et al. ..... 242/57
3,421,708 1/1969 Nicholson et al. ..... 242/57
3,553,992 1/1971 Harbaugh ..... 242/57
3,663,806 5/1972 Drankhan et al. ..... 242/57
4,021,002 5/1977 Meihofer ..... 242/57
4,089,482 5/1978 Mooney et al. ..... 242/57 X
4,151,403 4/1979 Woolston ..... 242/57 X
4,337,903 7/1982 Kessler et al. ..... 242/56 A X

FOREIGN PATENT DOCUMENTS 144821 11/1981 Japan ..... 242/57

*Primary Examiner*—John M. Jillions
*Attorney, Agent, or Firm*—Bernard, Rothwell & Brown

[57] ABSTRACT

System and apparatus for controlling of coiled material in a rolling line or in a process line, in which an instruction signal is produced at a predetermined moment to decrease the unwinding speed when the coiled material is to be unwound, the system and apparatus of the invention directly measuring the remaining number of turns n of coil on the mandrel without relying upon a circumferential difference which usually assumes a small value whereby precision in timing for initiating the deceleration can be increased.

4 Claims, 2 Drawing Figures

SYSTEM AND APPARATUS FOR CONTROLLING THE UNWINDING OF COILED MATERIAL

BACKGROUND OF THE INVENTION

1. Field of the Invention

The present invention relates to system and apparatus for controlling the unwinding of coiled material in a rolling line or a process line by generating instruction signals for reducing the unwinding speed at a predetermined moment.

2. Description of the Prior Art

FIG. 1 illustrates a conventional apparatus of this type which has various defects. Namely, FIG. 1 illustrates an automatic deceleration control apparatus which generates instruction signals for automatically decelerating the unwinding machine just before the material is all unwound. In FIG. 1, a material 2 is wound in the form of a coil on a unwinding mandrel 1 which is driven by an electric motor 3. Further, a speed indicating rotator 4 of the unwinder is coupled to the motor 3 directly or via a reduction means (not shown). Reference numeral 5 denotes a bridle which is driven by an electric motor 6. To the motor 6 is coupled a speed indicating rotator 7 directly or via a reduction gear (not shown). A counter 8 is connected to output terminals of the speed indicating rotators 4 and 7. The counter 8 produces the data related to the difference ΔC in circumference between the present circumferential length of the material and the circumferential length of the previous turn, as well as the data related to the length LR of the material wound on the mandrel 1 at a moment when the unwinding machine is to be decelerated. Relying upon the data ΔC, LR from the counter 8, an operation circuit 9 finds a circumferential length Cs of the coil at a moment when a deceleration instruction is to be produced. A comparator circuit 10 connected to the operation circuit 9 compares the circumferential length Cs of coil from the operation circuit 9 with a circumferential length CA of coil that is being treated, and produces a suitable deceleration instruction.

Automatic deceleration control system of the conventional unwinding machine will be described below. The coil length LR of the material 2 wound on the mandrel 1 is calculated in accordance with the following equation (1) at a moment when the unwinding machine is to be decelerated, based upon a line speed V (measured value) of the material 2 to be unwound and the remaining amount of coil Ld (preset value), $$LR = \frac{V^2 - Vo^2}{2\alpha} + Ld$$

where $\alpha$ denotes deceleration, and Vo denotes a line speed when the deceleration is finished.

When the line is to be stopped at this moment, the line speed Vo should be brought to zero.

Here, the circumferential length of coil of one turn is measured to find a circumferential difference ΔC (which corresponds to the thickness of the material 2 multiplied by $2\pi$) from the circumferential length of the previous turn.

If a coil of n turns is wound on the mandrel 1, the length Ln of the material wound on the mandrel 1 and the circumferential length (outermost circumference) Cn of a coil of one turn can be calculated according to the following equations:

$$Cn = \pi \cdot DM + n \cdot \Delta C \quad (2)$$

$$Ln = \sum^{n} Cn \quad (3)$$

where DM denotes a diameter of the mandrel.

Therefore, a minimum number of turns n which satisfies a relation, $$LR \leqq Ln \quad (4)$$

is found, and is denoted as Ns. If n=Ns is inserted into the equation (2), the circumferential length Cs of coil is found at a moment when the deceleration instruction is to be produced. That is, $$Cs = \pi \cdot DM + Ns \cdot \Delta C \quad (5)$$

The circumferential length Cs of the coil is compared with the circumferential length CA of the coil which is being treated. A series of these operations are carried out every time the coil is unwound by one turn. If the deceleration instruction is generated at a moment when the following relation, i.e., $$Cs \leqq CA \quad (6)$$

is established, the unwinding machine can be stopped at a suitable moment.

The above-mentioned deceleration control system will be described below in detail with reference to the conventional apparatus of FIG. 1.

The counter counts pulses produced by the speed indicating rotator 7 after every predetermined period of time to find a line speed V. The counter 8 also counts the number of pulses produced for every turn of the mandrel 1 to find the circumferential length CA of the coil. Relying upon the amount Ld of the remaining coil and the line speed V, the counter 8 further calculates a coil length LR at a moment at which the deceleration should be started, in accordance with the above-mentioned equation (1), and also finds the circumferential difference ΔC of the coil. Based upon the coil length LR, circumferential difference ΔC, and the diameter DM of the mandrel 1, the operation circuit 9 calculates the circumferential length Cs of coil at a moment at which the deceleration instruction should be produced, in accordance with the equations (2) and (3). The comparator circuit 10 performs the comparison as given by the equation (6), and produces the deceleration instruction when the equation (6) holds true.

According to the above-mentioned conventional system, however, the deceleration timing which is determined by a small value, i.e., by the circumferential difference ΔC, is subject to be greatly affected by the variance in the thickness of the material, by the slipping of the material and by the variance in the mandrel diameter.

Namely, the circumferential difference ΔC is very small, as given by, $$\Delta C = 2\pi \cdot h \quad (7)$$

where h denotes a thickness of the material. Here, however, it is difficult to suppress the pulse increment of the speed indicating rotator 7, which measures the circumferential length CA, so that the pulse increment is sufficiently smaller than the circumferential difference ΔC. Furthermore, slipping of the material turns out to be error factor in the circumferential difference ΔC. Thus, the deceleration timing is seriously affected by the disturbance. This tendency appears strikingly with the decrease in the thickness h of the material.

According to the conventional system in which the circumferential lengths are compared to find the deceleration timing, furthermore, variance in the diameter DM of the mandrel directly turns out to be an error factor in the circumferential length, and deteriorates the accuracy of the automatic deceleration control system. For the same reason, furthermore, the deceleration timing can be determined only once for every turn of the mandrel 1. Therefore, an error is inevitably introduced for every turn of the mandrel 1.

SUMMARY OF THE INVENTION

The principal object of the present invention is to provide system and apparatus for controlling the unwinding of coiled material, which are free from the above-mentioned defects inherent in the conventional art.

Another object of the present invention is to provide system and apparatus for controlling the unwinding of coiled material, which are capable of generating a deceleration instruction for maintaining high precision without being affected by disturbances such as pulse increment of the speed indicating rotator, slipping of the material, or variance in the diameter of the mandrel.

A further object of the present invention is to provide a system and apparatus for controlling the unwinding of coiled material, which continually measure the remaining number n of turns of the material, and which, hence, features strikingly increased precision compared with the conventional sampling control systems.

Other objects and features of the invention will become obvious from the following description taken in conjunction with the accompanying drawings.

DESCRIPTION OF A PREFERRED EMBODIMENT

Figure 1:
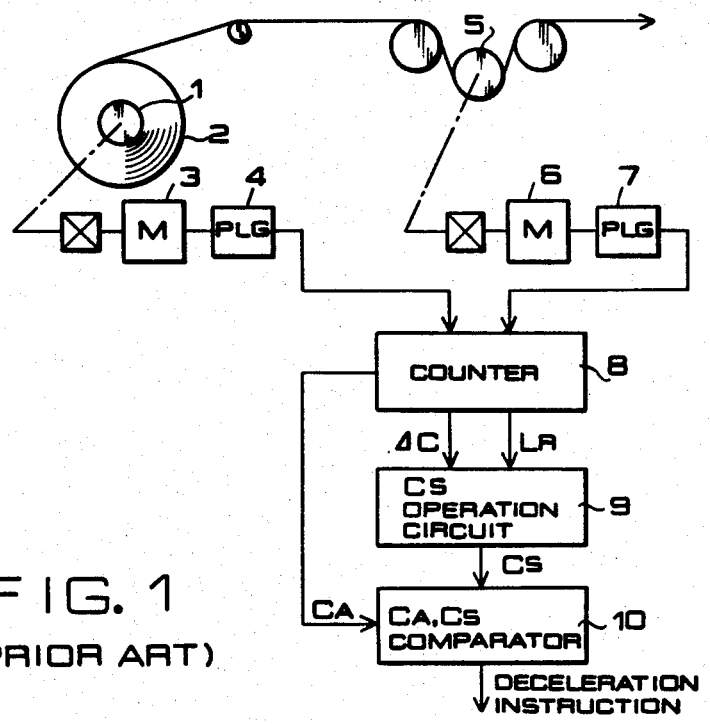
FIG. 1 (PRIOR ART)
FIG. 1 is a block diagram of an automatic deceleration control apparatus according to a conventional system.
Figure 2:
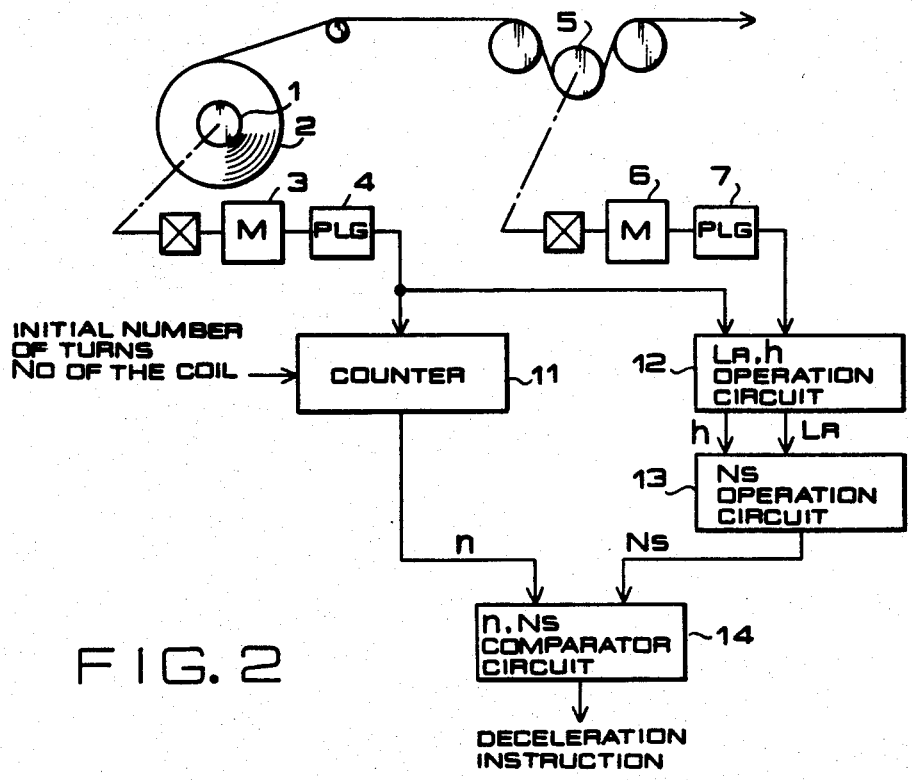
FIG. 2 is a block diagram of an automatic deceleration control apparatus according to the system of the present invention.

FIG. 2 is a block diagram of an automatic deceleration control apparatus according to an embodiment of the present invention, in which the same symbols as those of FIG. 1 denote the same portions or the corresponding portions.

Upon receipt of the output of the speed indicating rotator 4, a counter 11 measures the remaining number of turns of the coil. Being served with the outputs of the speed indicating rotators 4 and 7, an operation circuit 12 calculates the remaining length of the coil and the thickness of the material at the time when the deceleration is to be started. Relying upon the length of the remaining coil and the thickness of the material obtained by the above operation circuit 12, an operation circuit 13 calculates the remaining number of turns of the coil wound on the mandrel 1 at the time when the deceleration is to be started. Further, a comparator circuit 14 always compares the present number of turns measured by the counter 11 with the remaining number of turns at the moment when the deceleration is to be effected as calculated by the operation circuit 12, and produces a deceleration instruction when they are in agreement.

According to this embodiment, the initial number of turns No of the coil is preset to the counter 11 when the coil is loaded onto the mandrel 1 and the tip of the coil is detected. The preset value is then down-counted responsive to pulses generated by the speed indicating rotator 4 accompanying the turning of the mandrel 1, thereby to measure the remaining number of turns n of the coil on the mandrel 1. Responsive to this data, the timing for commencing the deceleration is calculated.

The process of its operation will be described below in detail. First, like the conventional one, the operation circuit 12 calculates the coil length LR wound on the mandrel 1 relying upon the line speed V and the remaining amount Ld of the coil in accordance with the equation (1) at a moment when the deceleration is to be initiated. Like the conventional one, furthermore, the circumferential difference ΔC is found from that of the previous turn, and the thickness h of the material is calculated in accordance with the following equation, $$h = \frac{\Delta C}{2\pi} \quad (8)$$

The number of turns Ns of the coil which corresponds to the coil length LR which is given by, $$LR = Ns \cdot \pi \cdot (DM + Nsh) \quad (9)$$

is found by the operation circuit 12.

The counter 11, on the other hand, measures remaining number of turns n of the coil wound on the mandrel. That is, if the number of turns No of the coil when it is loaded on the mandrel is denoted by No, and if the pulse increment of the speed indicating rotator 4 mounted on the mandrel-driving motor 3 is converted into the number of revolutions of the mandrel, i.e., denoted by P degrees/pulse, the remaining number n of turns is given by, $$n = No - \frac{P \cdot Cn}{360} \text{ [turns]} \quad (10)$$

where Cn denotes a number of pulses counted from the moment when the end of the coil is detected.

The number of turns Ns found according to the equation (9) and the remaining number of turns n found according to the equation (10) are then compared at all times by the comparator circuit 14. The deceleration instruction is produced when $Ns \leqq n$.

The present invention can be adapted not only to the unwinding machine used in the rolling line or in the process line but can also be adapted to other unwinding machines which work to decelerate the line speed just before the material is all unwound.

The thickness h of the material is found from the circumferential difference ΔC in accordance with the equation (8). Therefore, error in the circumferential difference ΔC may cause measurement of the thickness h of the material to become incorrect. Error, however, can be eliminated by averaging the measured values.

Since the thickness h of the material is substantially constant through the same coil, data with a small measuring error, which is obtained in a stable operation is utilized as a typical value, or set data is used so that the measuring error may be reduced and thereby the precision can be elevated.

In finding the number of turns Ns of the coil according to the equation (9), the thickness h of the material is very small compared with the mandrel diameter DM. Therefore, even if variance is contained in the thickness h, little error is introduced into the number of turns Ns of the coil.

According to the present invention as illustrated in the foregoing, the residual number n of turns is directly and continually measured according to the equation (10), without relying upon a very small value, i.e., without relying upon the circumferential difference $\Delta C$ that was employed in the conventional art. Therefore, the apparatus is not affected by the disturbance such as pulse increment of the speed indicating rotator 7, slipping of the material or variance in the mandrel diameter and, hence, produces the deceleration instruction maintaining high precision. It is further possible to realize system and apparatus for controlling the unwinding of coiled material, which is not affected by the thickness h of the material.

Further, since the remaining number of turns n is measured continually (after every pulse period of the speed indicating rotator 4), the precision is greatly increased compared with the conventional system of sampling control effected after every turn of the mandrel.

What is claimed is:

1. A method for controlling the unwinding of a coil of coiled material in a rolling line or in a process line, when coiled materiai loaded on a mandrel is to be unwound comprising the steps of:

(a) continuously measuring the number of turns of the coil to derive a first signal indicating the remaining number of turns of coil wound on said mandrel as said mandrel is unwinding;

(b) continuously producing a second signal indicating the speed of said material;

(c) continuously producing a third signal by calculating the number of turns of the material wound on said coil at the moment when deceleration is to be initiated based on said second signal;

(d) continuously comparing said first and third signals; and (e) producing a deceleration instruction when said third signal is less than or equal to said first signal.

2. The method of claim 1 wherein step (a) includes the steps of:

(1) presetting the initial number of turns of the coil in a counter when the coiled material is loaded onto the mandrel;

(2) down-counting the preset number of turns in response to pulses produced by a speed-indicating rotator which is responsive to the turning of the mandrel thereby to measure the remaining number of turns of the coil wound on the mandrel at all times.

3. An apparatus for controlling the unwinding of coiled material comprising:

(a) a mandrel on which a web-like material is wound in the form of a coil;

(b) a counter for presetting an initial number of turns of a coil and subtracting the number of turns from said initial number of turns in accordance with the rotation of said mandrel when said coil is unwound;

(c) a first calculation circuit for calculating the desired remaining amount of coil LR at a moment when the deceleration is to be initiated from the actual speed V of the web-like material unwound from said mandrel, the set deceleration factor $\alpha$, the desired speed Vo of the web-like material when the deceleration is finished and the desired remaining amount Ld of coil when the deceleration is finished;

(d) a second calculation circuit for calculating the number of revolutions Ns of said mandrel corresponding to the output LR derived from said first calculation circuit; and (e) a comparator for comparing the output of said counter with the output of said second calculation circuit, and releasing deceleration instructions at the deceleration factor $\alpha$ to said mandrel when said both outputs are in coincidence with each other.

4. An apparatus for controlling the unwinding of coiled material according to claim 3, wherein the desired speed Vo of the web-like material when the deceleration is finished is zero.

* * * * *

UNITED STATES PATENT AND TRADEMARK OFFICE

CERTIFICATE OF CORRECTION

PATENT NO. : 4,463,913

DATED : August 7, 1984

INVENTOR(S) : Yoshiaki Sato

It is certified that error appears in the above-identified patent and that said Letters Patent is hereby corrected as shown below:

Column 6, line 1, after the word "instruction" insert the word --signal--.

Signed and Sealed this

*Fifth* Day of *March 1985*

[SEAL]

*Attest:*

DONALD J. QUIGG

*Attesting Officer* *Acting Commissioner of Patents and Trademarks*